US005839307A

United States Patent [19]

Field et al.

[11] Patent Number: 5,839,307

[45] Date of Patent: Nov. 24, 1998

[54] ELECTROMECHANICAL CYLINDER LOCK WITH ROTARY RELEASE

[75] Inventors: Peter Field, Salem; Michael Lumpkin, Roanoke, both of Va.

[73] Assignee: Medeco Security Locks, Inc., Salem, Va.

[21] Appl. No.: 874,285

[22] Filed: Jun. 13, 1997

[51] Int. Cl.[6] ..... E05B 47/06

[52] U.S. Cl. ..... 70/283; 70/276; 70/495

[58] Field of Search ..... 70/276–283, 495, 70/496, DIG. 62, 375, 419–421

[56] References Cited

U.S. PATENT DOCUMENTS

| | | | |
|---|---|---|---|
| 3,570,287 | 3/1971 | Hallmann | 70/276 |
| 3,935,720 | 2/1976 | Boving | 70/276 |
| 4,253,320 | 3/1981 | Schwab et al. | 70/276 |
| 4,287,733 | 9/1981 | Gomez-Olea | 70/276 |
| 4,333,327 | 6/1982 | Wake | 70/276 |
| 4,665,726 | 5/1987 | Drunbauer et al. | 70/276 |
| 4,712,398 | 12/1987 | Clarkson et al. | 70/276 |
| 5,010,750 | 4/1991 | Boser et al. | 70/283 X |
| 5,209,087 | 5/1993 | Cox | 70/495 X |
| 5,507,162 | 4/1996 | Chhatwal | 70/283 X |
| 5,542,274 | 8/1996 | Thordmark et al. | 70/495 |
| 5,561,997 | 10/1996 | Milman | 70/283 |
| 5,699,686 | 12/1997 | Neumayer et al. | 70/283 |
| 5,752,400 | 5/1998 | Kim | 70/495 X |

FOREIGN PATENT DOCUMENTS

| | | | |
|---|---|---|---|
| 446045 | 1/1948 | Canada | 70/495 |
| 237799 | 9/1987 | European Pat. Off. | 70/495 |

*Primary Examiner*—Suzanne Dino Barrett
*Attorney, Agent, or Firm*—Rothwell, Figg, Ernst & Kurz

[57] ABSTRACT

An electromechanical cylinder lock includes an outer lock shell and a rotatable lock barrel located therein which is controlled by dual locking features. A side bar or fence selectively blocks and permits rotation of the barrel with respect to the shell in response to insertion of a key into a keyway in the barrel. The barrel includes a plurality of electromechanical locking members with grooves formed therein, the locking members being movable to a position in which the grooves are aligned to accept the side bar or portions thereof. An electromagnetic core disposed in the barrel is energized in response to a control device which determines whether an attempt to open the lock is authorized, the magnetic core rotating the electromechanical locking members to a desired position relative to the side bar to allow rotation of the barrel. The locking members may be flat disc-shaped elements with a portion cut out to form a groove. As the electromagnetic core (or other electronically powered drive mechanism) and the locking members are substantially entirely contained in the barrel, mechanical cylinder locks may be retrofitted to form an electromechanical lock by removing and replacing the purely mechanical barrel with the electronically driven barrel.

19 Claims, 8 Drawing Sheets

ELECTROMECHANICAL CYLINDER LOCK WITH ROTARY RELEASE

BACKGROUND OF THE INVENTION

1. Field of the Invention

The present invention relates generally to an electromechanical cylinder lock and, in particular, a cylinder lock in which a plurality of electro-mechanical locking members are contained within a rotatable barrel or plug disposed within the cylinder.

2. Description of Related Art

Electromechanical locking devices are known which include electrically interfaced or controlled release mechanisms for operating a lock cylinder. For example, U.S. Pat. No. 4,712,398 discloses an electronic locking system comprising a lock cylinder with a rotatable plug located therein. An electronically activated release assembly is provided which selectively disengages a locking pin from the plug to allow turning of the key to rotate the plug relative to the cylinder. The lock cylinder and key each include an electronic memory device containing keying system codes. Upon insertion of the key the release mechanism disengages the locking pin from the plug to allow its rotation.

One benefit of including electronic control features in locks is the ability to provide increased keying codes for operating the lock. For example, information can be stored in the lock and/or key such that the locking mechanism is activated in response to detecting and/or exchanging data. As the information stored in the components may be altered, it is possible to vary the keying codes without changing the system hardware. In contrast, changing the keying codes in a purely mechanical lock typically requires forming a new key with different bitting surfaces, a more involved process than reprogramming electronic components of an electromechanical lock.

Despite progress made in the development of prior art electromechanical locking systems, several deficiencies exist which leave room for improvement. For example, prior art systems do not provide the ability to retrofit a purely mechanical lock to form an electromechanical lock which is operated at least in part by information stored in a key and/or lock cylinder. The benefits of retrofitting a mechanical lock in this manner include preventing the need to alter the keying of the lock should it become necessary to change the combination, for example when an employee loses his or her key or leaves an establishment. In such a case, the components of the lock may be reprogrammed to change the keying codes to prevent the employee's key from operating the lock. Accordingly, there remains a need in the art for an improved electromechanical cylinder lock system.

SUMMARY OF THE INVENTION

The present invention provides an electro-mechanical cylinder lock having at least one, and preferably dual locking features. The lock includes an outer shell or cylinder member, a barrel rotatably mounted within the shell, and a plurality of tumbler pins which are lifted to a shear line of the barrel and shell to operate the lock. A side bar or fence member is provided and cooperates between the shell and barrel to selectively block or permit rotation of the barrel. The side bar has an outer edge located in a cavity formed in the shell and is spring biased toward the cavity. The side bar is moved out of the cavity and toward the barrel in order to permit rotation of the barrel. A plurality of electromechanical locking members are located within the barrel and each has a groove or slot formed therein for accommodating the side bar. The locking members are movable between a first position in which the grooves are not aligned and will not receive the side bar or permit the barrel to be rotated, and a second position in which the grooves are aligned and receive the side bar such that the barrel can be rotated to move the side bar out of the cavity in the shell.

An electronically powered drive mechanism is located within the barrel and is activated to move, e.g. by rotating, the locking members to allow rotation of the barrel. The drive mechanism may be an electromagnetic core located in the barrel a suitable distance from the locking members, and the locking members may be formed of a ferromagnetic material so as to rotate to a desired position upon application of current to the core. The drive mechanism and the locking members preferably are substantially entirely contained in the barrel to form a self-contained, removable component which may be substituted for the mechanical barrel of known lock cylinders.

A control device, for example a microprocessor located within or outside the barrel, is provided and has data stored therein including authorized codes for operating the lock. The control device compares data read or detected from the user's key to determine whether the drive mechanism should be activated to move the locking members to an unlocking position. The lock cylinder preferably includes a keyway and a plurality of tumbler pins, the keyway receiving a key which is bitted to position the pins at a shear line which permits the barrel to be rotated. The key is provided with means for carrying data, for example, a microchip, magnetic data-encoded strip, transmitter, etc., such that upon insertion into the keyway the control device compares the data carried by the key to determine whether the attempt to operate the lock is authorized, and if so, activates the drive mechanism to move the locking members to an unlocking position.

An important benefit of the invention resides in the fact that the movable locking members and electronically powered drive device are entirely (or substantially entirely) contained within the barrel. This permits the entire barrel to be removed and placed in the outer shells of different lock cylinders. The invention permits the barrel to be substituted for the barrel of a purely mechanical cylinder lock to retrofit the lock into an electromechanical lock system. In addition, the invention contemplates utilizing different but interchangeable electromechanical barrels with a plurality of lock cylinders in a lock system. Moreover, the compact, removable barrel may carry some or all of the electronic hardware and/or software associated with the lock to provide even greater flexibility in various applications.

BRIEF DESCRIPTION OF THE DRAWINGS

Other objects, features and benefits of the invention will become apparent from the detailed description of preferred embodiments set forth below, taken in conjunction with the accompanying drawing figures, wherein.

DETAILED DESCRIPTION OF PREFERRED EMBODIMENTS

Figure 1:
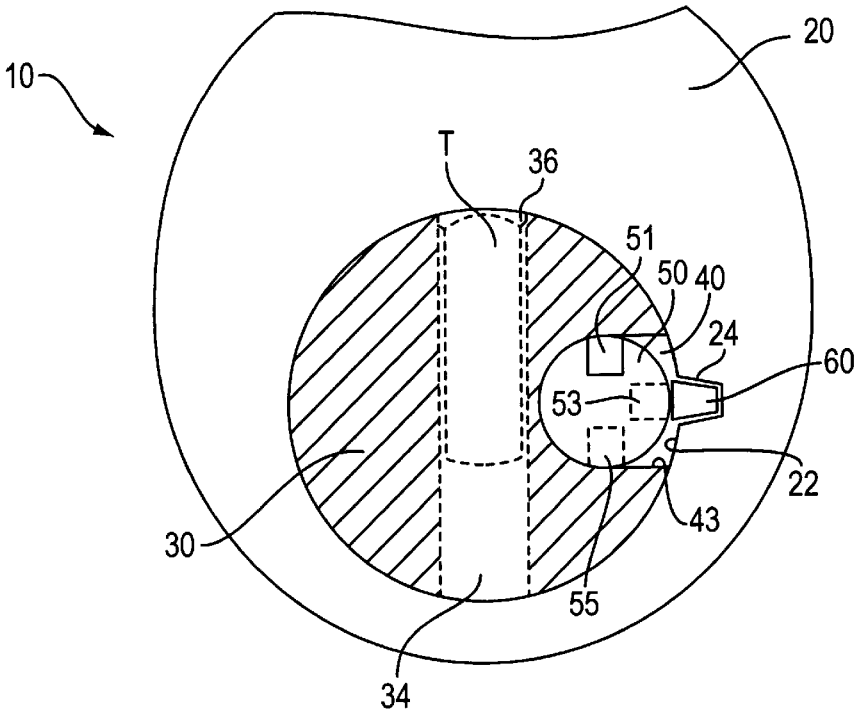
FIG. 1 is a front elevation view in section of a lock cylinder including a shell, a rotatable plug containing movable locking members, and a side bar constructed according to one embodiment of the present invention, the movable locking members and side bar being oriented in a cylinder locking position.

With reference to FIGS. 1–5, a first embodiment of the present invention is indicated generally by the reference numeral 10 and includes a cylinder or outer shell 20 having a bore 22 in which is positioned a rotatable barrel or plug 30. The barrel 30 has an outer surface 32 substantially corresponding to the bore 22 of the shell and includes a keyway 34 configured to receive a key as is known in the art. The barrel 30 includes a plurality of tumbler pin bores 36 which receive tumbler pins T (one of which is illustrated schematically in FIG. 1). The manner in which a properly bitted key (not shown) engages the tumbler pins and positions them at a shear line to permit the barrel 30 to be rotated with respect to the shell 20 is known in the art and thus will not be described in any great detail herein. However, it should be noted that the tumbler pins may be simply lifted by the bitting surfaces on the key, or they may be lifted rotatively by a key including skew cut bitting surfaces, such as that used with a Medeco®type cylinder lock.

The shell 20 includes a cavity 24 in which is positioned a side bar or fence 60 which cooperates with the barrel 30 to either block or permit rotation of the barrel within the shell. As discussed below, the upper wall of the cavity 24 is formed as a camming surface for moving the side bar out of the barrel upon rotation of the barrel. As can be seen in FIG. 1, which shows the side bar 60 and locking members 50, 52, 54 (discussed in detail below) in a barrel rotation blocking position, the side bar is received in cavity 24 and its inner edge extends beyond the internal surface of shell bore 22 and engages the barrel 30 to prevent the barrel from rotating to operate the lock. However, when the locking members 50, 52, 54 are moved to the unlocking position shown in FIG. 3, the barrel may be rotated to cam side bar 60 out of cavity 24 so as to clear the inner surface of bore 22 and permit rotation of the barrel 30 with respect to the shell 20.

The side bar 60 preferably is cammed out of shell cavity 24 upon insertion of a properly bitted key and rotation of the barrel. For example, the side bar may be moved out of the cavity as described in U.S. Pat. No. 4,732,022, assigned to the assignee of the present application, the subject matter of which is incorporated herein by reference. As described in the U.S. Pat. No. 4,732,022 patent, one or more side bar springs (not shown) may be positioned between the inner edge of the side bar (to the left in FIG. 1) and the barrel, e.g. the inner wall of recess 40 or any other suitable location on the barrel. The springs bias the side bar into cavity 24 (to the right in FIG. 1) to prevent the barrel from rotating.

Figure 9:
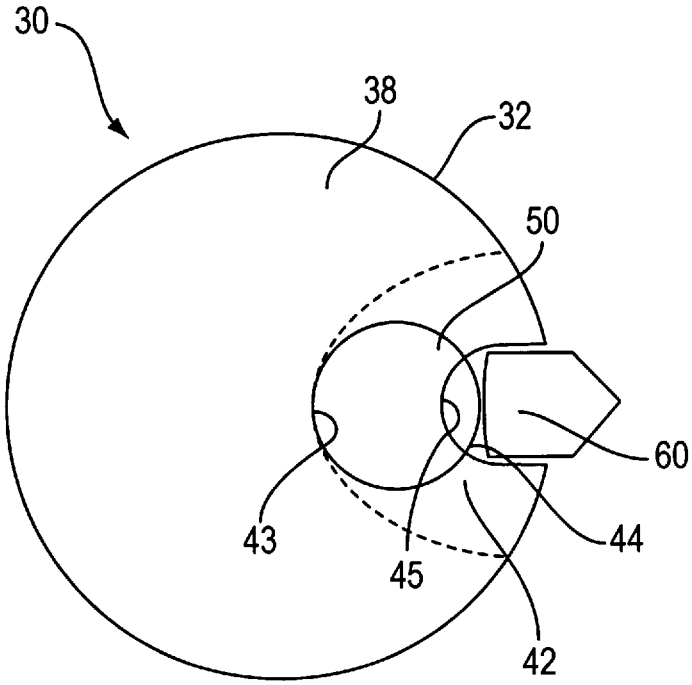
FIG. 9 is a front elevation view of the plug of the cylinder depicted in the above embodiment.

In a preferred embodiment, the inner edge of the side bar 60 is received in the narrow end portions 44 of recess 40, as seen in FIG. 9. FIG. 9 is a transverse sectional view of the barrel shown in FIGS. 1 and 2 cutting therethrough so as to pass through one of the recess end portions 44 (whereas the transverse sectional view of FIG. 1 cuts through the larger central portion 42 of recess 40). Thus, when in a locked position, the side bar 60 is secured, but slidable, within the barrel 30. The side bar 60 is biased into the cavity 24 by the springs with the inner edge of the side bar received in the recess portions 44.

When the locking members 50, 52, 54 are moved to an unlocking position to align the grooves 51, 53, 55, the barrel 30 can be rotated so that the camming surface of shell cavity 24 slides the side bar out of the cavity and toward the barrel, the inner edge of the side bar being free to move into the aligned grooves in the locking members. Thus, upon turning the key and rotating the barrel, the side bar is moved out of cavity 24 to operate the lock.

Figure 2:
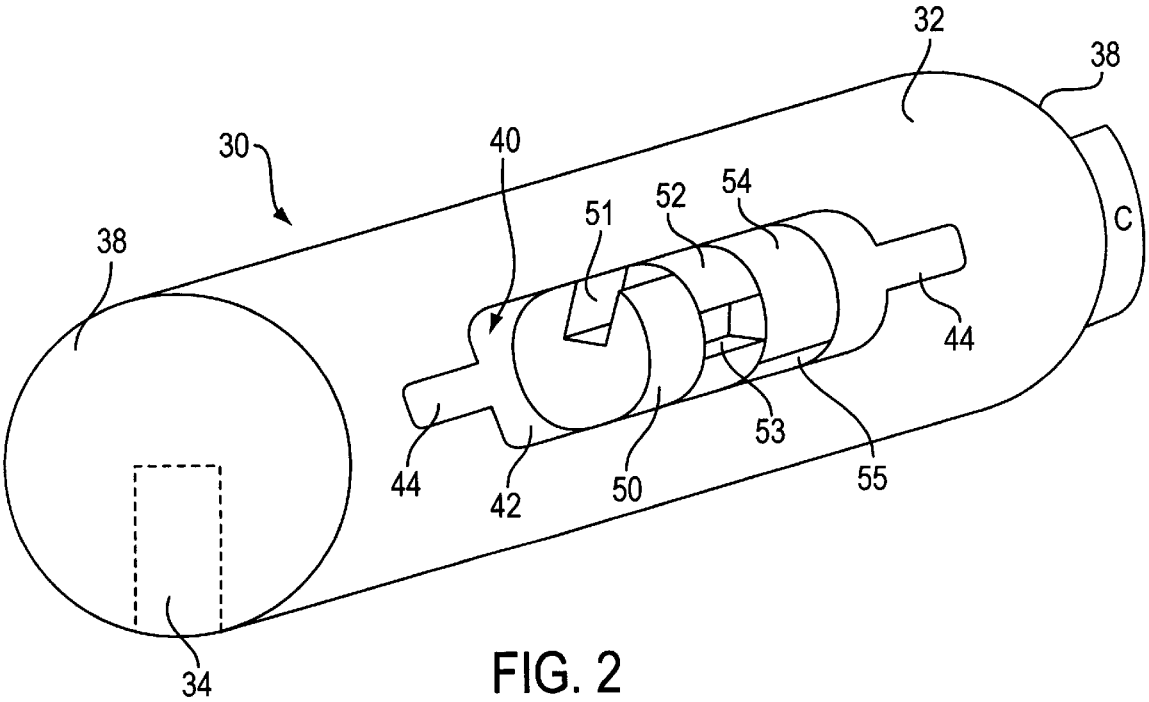
FIG. 2 is a perspective view of the plug and locking members of the lock cylinder of FIG. 1.

Referring to FIG. 2, the rotatable barrel 30 is shown in more detail and includes opposite ends 38 and a keyway 34 for receiving a key. The keyway 34 preferably, though not necessarily, extends completely through the length of the barrel (for manufacturing purposes). A control device, for example a microcomputer or processor, microchip, etc., (indicated schematically at C in FIGS. 1 and 3), is provided to control operation of the lock. In this embodiment, the control device C is secured to a back end 38 of the barrel 30. However, because the microchip is secured to the back end of the barrel it is not accessible by a user attempting to operate the lock. In such arrangements the chip would be located away from the exterior of the lock, for example, behind a door, within a vending machine, a gaming or casino machine, parking meter, etc., and thus would be inaccessible from the exterior of the lock. Of course, those skilled in the art will recognize that the applications mentioned above are only several examples of how the present invention may be utilized.

Figure 6:
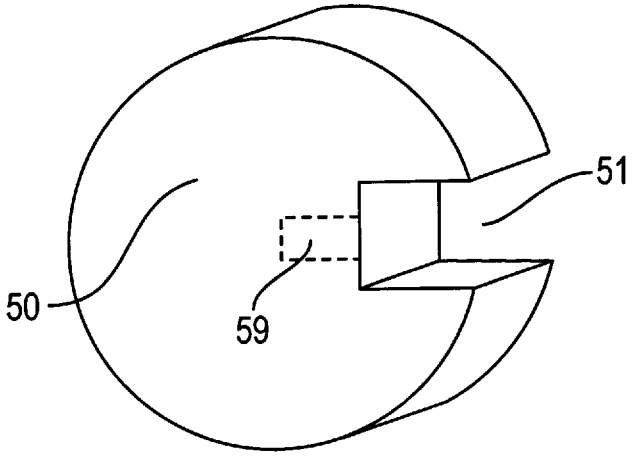
FIG. 6 is a perspective view of one of the movable locking members of the embodiment depicted in FIG. 1.

As seen in FIG. 2 and discussed above, a recess 40 is formed in the barrel 30 and, in a preferred embodiment, includes an enlarged central portion 42 and end portions 44. A plurality of electromechanical locking members 50, 52, 54 preferably are located within the central recess portion 42. The locking members are referred to as electromechanical because, as described below, they are moved under the force of an electronically powered drive mechanism. The locking members 50, 52, 54 are preferably disc-shaped with opposite flat surfaces joined by a cylindrical portion. The locking members 50, 52, 54 respectively include grooves or slots 51, 53, 55 which may be formed as cut-out portions extending a desired distance inward from the outer surface of each disc-shaped element (FIG. 6). Of course, those skilled in the art will recognize that the particular shape of the locking members and the size and configuration of the grooves are not critical and may be varied without altering the members' ability to generally function as described above.

Figure 3:
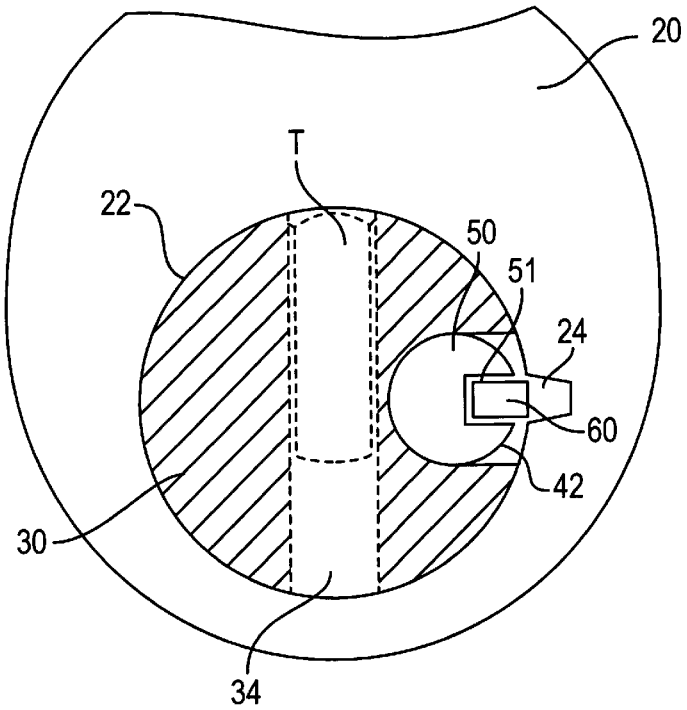
FIG. 3 is a front elevation view in section of a lock cylinder of FIG. 1 with the movable locking members and side bar oriented in a cylinder unlocking position.
Figure 4:
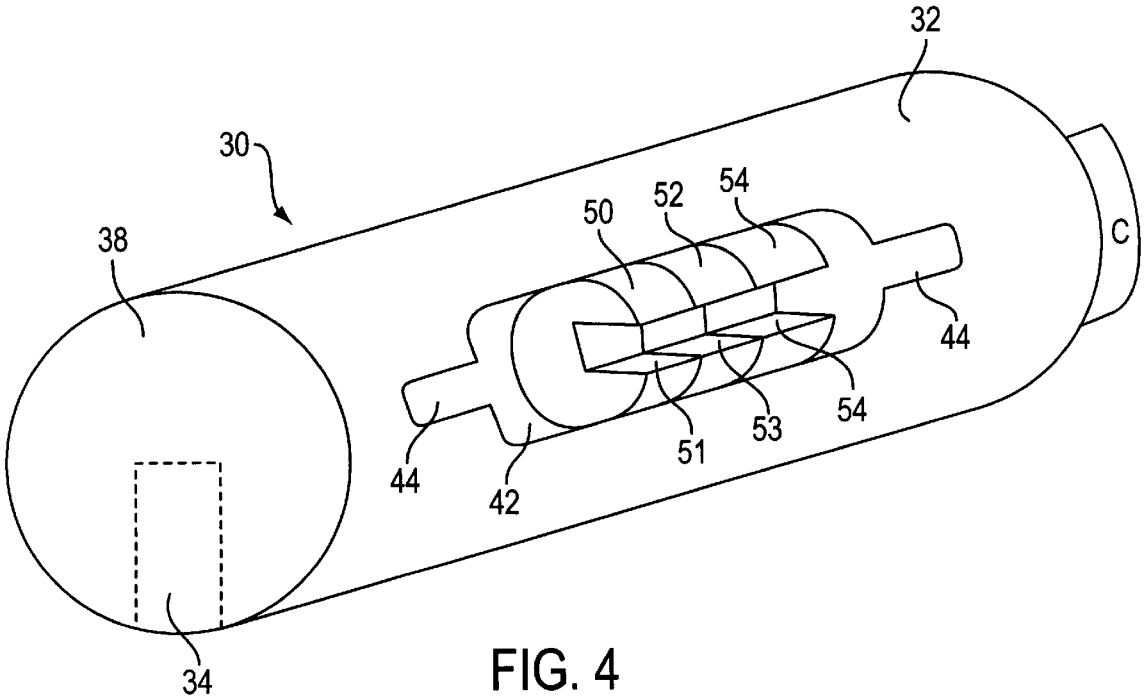
FIG. 4 is a perspective view of the plug and locking members of the lock cylinder of FIG. 3.
Figure 5:
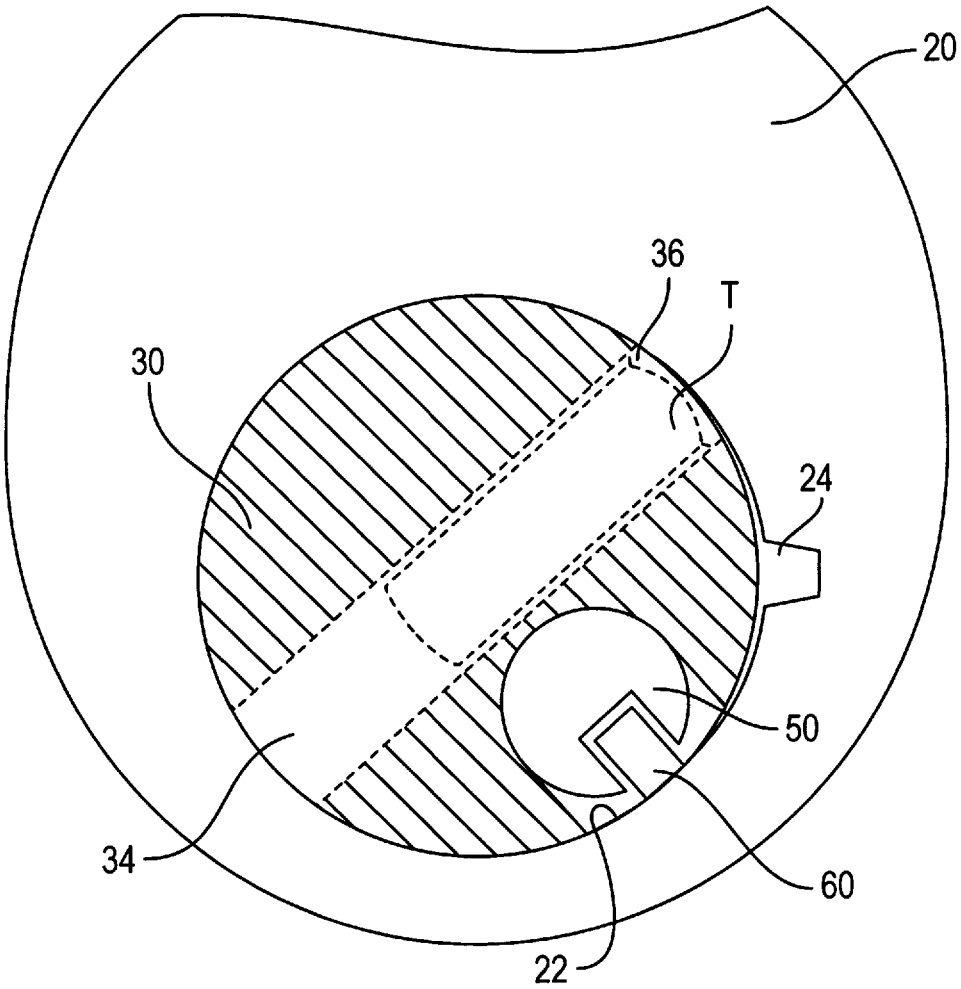
FIG. 5 is a front elevation view in section of a lock cylinder of FIGS. 1-4 with the movable locking members and side bar oriented in the cylinder unlocking position and the plug rotated with respect to the shell.

The grooves 51, 53, 55 in locking members 50, 52, 54 are configured to receive an inner edge of the side bar 60 (or, alternatively, a portion thereof) when the side bar is moved out of the cavity 24 in shell 20. FIGS. 1 and 2 show the locking members in a barrel blocking position with the grooves 51, 53, 55 not aligned. In contrast, FIGS. 3 and 4 show the locking members in a position which permits rotation of the barrel, wherein the grooves 51, 53, 55 are aligned and receive the inner edge of the side bar 60 when the opposite edge of the side bar is cammed (against the force of the springs) out of the cavity 24 in the shell 20 and toward the barrel 30.

Figure 7A:
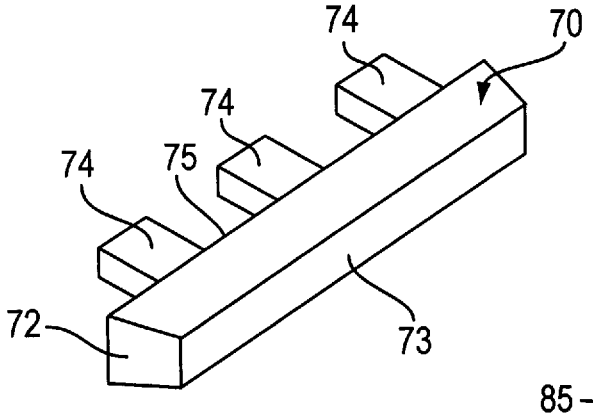
FIGS. 7A and 7B are perspective views of alternative side bar configurations which may be utilized with the present invention.
Figure 7B:
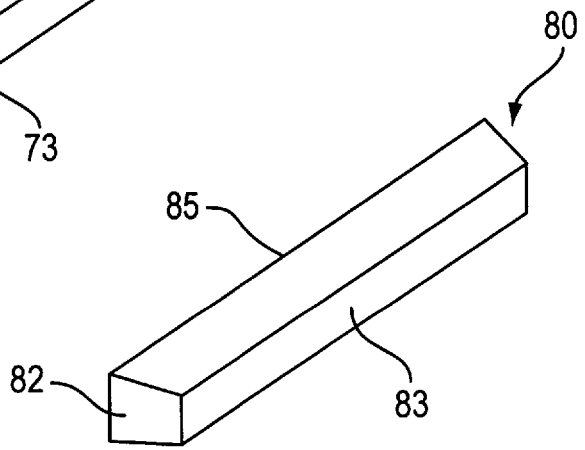

FIGS. 7A and 7B show two possible embodiments of side bars which may be utilized with the invention. The side bar 70 (FIG. 7A) includes opposite ends 72, an outer edge 73, and an inner edge 75. A plurality, for example three, side bar legs 74 extend outwardly from the inner edge 75. The side bar 80 (FIG. 7B) includes opposite ends 82, and outer edge 83, and an inner edge 85. This type of side bar does not have legs extending therefrom but may be used with the inner edge 85 of the side bar received in the grooves 51, 53, 55 (or at least a portion of the grooves) of the locking members 50, 52, 54. For example, the embodiment of FIGS. 1–5 includes a side bar 60 the inner edge of which is received in the grooves in the locking members.

The legs 74 of side bar 70 (FIG. 7) enter the grooves 51, 53, 55 of locking members 50, 52, 54 upon rotation of the barrel (which cams the side bar 70 out of cavity 24 and toward the barrel 30). The legs 74 preferably are sized such that the inner edge 75 of the side bar 70 rests against the outer surface of the locking members, though this is not necessary to carry out the invention. Alternatively, it is possible to form grooves in the locking members which include two portions that extend different distances, e.g. in a stepped fashion, into the cylindrical body of the disc-shaped locking members. For example, FIG. 6 depicts (in phantom) groove 51 which includes a first deep grooved portion 59 that extends a greater distance than the main portion of the groove (shown in solid lines). In this embodiment, the legs 74 of side bar 70 preferably are received in the deep groove portions 59 while the inner edge 75 of the side bar is received in the main portion of grooves 51, 53, 55 of locking members 50, 52, 54. Further, the side bars 60, 70 or 80 may include an inner edge stepped in similar fashion to include two (or more) portions which respectively are received in the two (or more) portions of the groove. Those skilled in the art will appreciate that the specific configurations of the side bar or fence and the rotatable barrel and locking members can be varied depending on the particular application of the invention.

Figure 8:
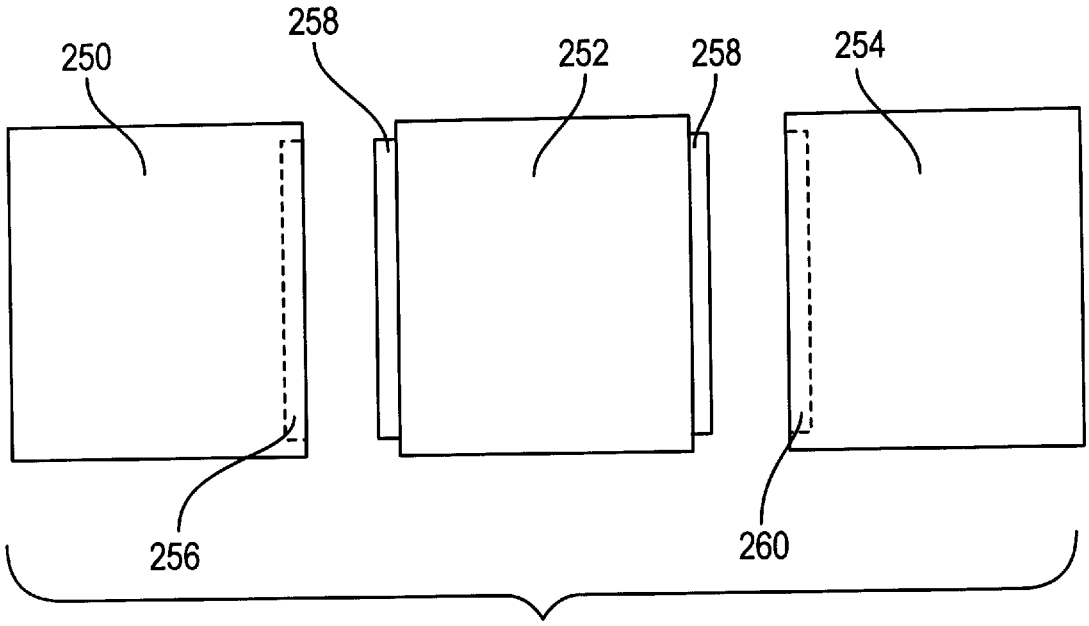
FIG. 8 is an exploded view of one embodiment of movable locking members which may be utilized with the present invention.

FIG. 8 shows a plurality of electromechanical locking members 250, 252, 254 according to another embodiment of the invention. While three locking members are depicted in the drawing, more or less members may instead be utilized. Inner locking member 252 and outer locking members 250 and 254 preferably are cylindrically shaped and have grooves (not shown) formed therein as in the above-described embodiment. The grooves may be provided only in outer locking members 250 and 254, or in all three members. The inner locking member 252 is provided with projections 258 which are received in the recessed or beveled edge portions of outer locking members 250 and 254. Any suitable means of removably securing the inner and outer locking members together, for example mating lugs and recesses, may be used so that outer members 250, 254 are engaged and driven by the inner locking member 252. That is, the inner locking member can be driven alone with the motion transmitted to the outer members.

Alternatively, each of the locking members may individually be rotated by the drive mechanism. In a most preferred embodiment, the locking members are rotated in opposite directions by the drive mechanism to provide increased security. With this arrangement it is not likely that the discs can be moved to their unlocking location by an unauthorized attempt to operate the lock, such as by jarring or otherwise manipulating the lock. For example, the outer locking members 250, 254 may be rotated in opposite directions with respect to the inner member 252.

Figure 15:
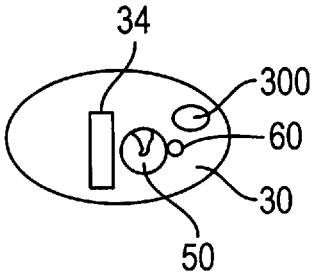
FIG. 15 is a schematic diagram of the rotatable barrel of the embodiment shown in FIGS. 1–5.

In a preferred embodiment, the locking member (or members) is driven or rotated by any suitable electronically powered drive mechanism, for example, an electromagnetic core, a miniature motor whose output drives the inner locking member, etc. A preferred arrangement of the drive mechanism and the locking members is shown schematically in FIG. 15. The barrel 30 includes a keyway 34, side bar 60 and locking members 50, 52, 54 (only one of which is depicted) as discussed above. An electromagnetic core 300 is located in the barrel 30 at a position proximal to the locking members such that upon energizing the core 300, the resulting magnetic field rotates the members from their locking position (FIG. 2) to their unlocking position (FIG. 4) so as to permit the side bar 60 to move out of the cavity in the shell (not shown) and into engagement with the locking members. The locking members may either be formed of a ferromagnetic material, in whole or in part, or may include a ferromagnetic insert.

As noted above, FIG. 9 depicts the rotatable barrel 30 in transverse section taken through one of the recess portions 44. The interior surface 43 of central recess portion 42 and the interior surface 45 of end recess portion 44, as shown in the drawing, preferably are formed as concave or generally hemispherically shaped indentations in the barrel 30. However, the recesses could take other shapes; in addition, the central recess 42 could have the same or a different configuration than the end recesses 44. In each case, it is desirable that the recess in the barrel receive the corresponding locking members snugly while allowing their movement to and from the locking and unlocking positions. Similarly, it is desirable that the recess 40 engage the side bar in some fashion such that upon rotation of the barrel 30 the side bar is likewise rotated relative to (and cammed by) the cavity 24 in the shell.

Figure 10:
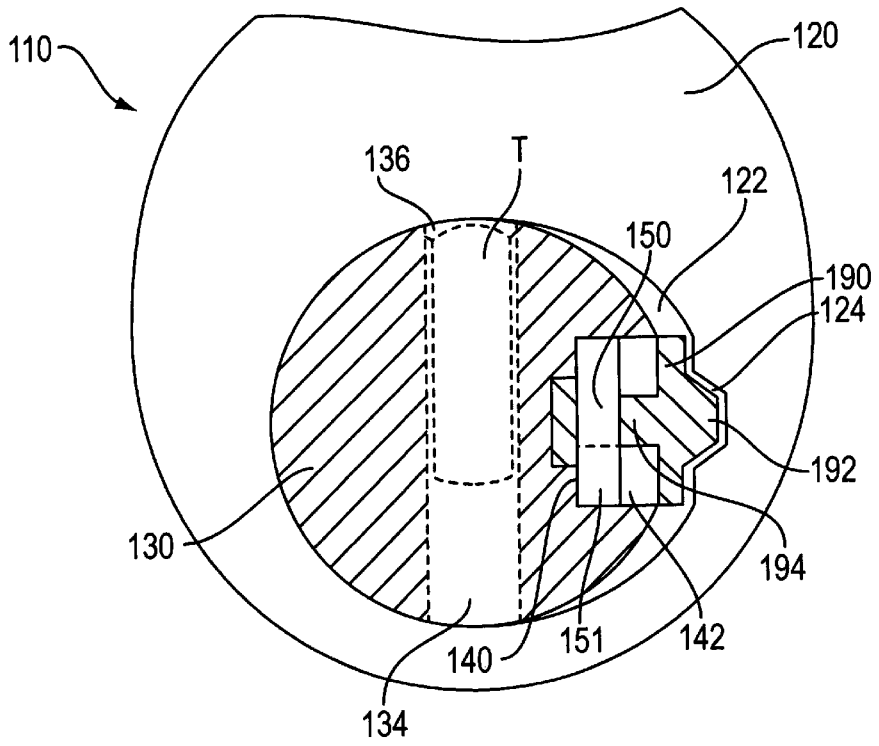
FIG. 10 is a front elevation view in section of a lock cylinder including a shell, a rotatable plug containing movable locking members, and a side bar constructed according to a further embodiment of the present invention, the movable locking members and side bar being oriented in a cylinder locking position.

Another embodiment of the invention is indicated generally by reference numeral 110 in FIGS. 10–14 and includes a cylinder or outer shell 120 having a bore 122 in which is positioned a rotatable barrel or plug 130. The barrel 130 has an outer surface which substantially corresponds to the bore of the shell 120, and also includes a keyway 134 for receiving a key and which desirably extends the full length of the barrel. The barrel 130 includes a plurality of tumbler pin bores 136 which receive tumbler pins T (only one of which is illustrated in FIG. 10). A plurality of electromechanical locking members 150, 152 are movably positioned within the recess 140 formed in barrel 130 (as discussed below).

As in the previous embodiment, the shell 120 includes a cavity 124 in which is positioned a side bar or fence 190 which either blocks or permits rotation of the barrel within the shell. As seen in FIG. 10, the side bar 190 includes an outer projecting edge 192 and an inner projecting edge 194. FIG. 10 shows the side bar 190 and locking members 150, 152 in a barrel rotation blocking position, with the outer edge 192 of side bar 194 received in cavity 124 of the shell 120. The barrel recess 140 is formed with a central portion 142 and end portions 144 as in the above embodiment; however, as the locking members are oriented with their flat surface engaging the recess 140, the latter is rectangularly shaped rather than concave shaped.

In the locking position, the inner edge 194 of the side bar extends beyond the internal surface of shell bore 122 and engages a portion of the barrel recess 140 such that the barrel 130 cannot rotate with respect to the shell to operate the lock. However, when the locking members 150, 152 are moved from the position shown in FIGS. 10 and 11 to the unlocking position shown in FIGS. 12 and 13 upon insertion of the key, the barrel may be rotated which cams the side bar 190 out of cavity 124 so as to clear the inner surface of bore 122 to operate the lock.

The locking members 150, 152 preferably are formed as flat discs and have the same construction as locking members 50, 52, 54 discussed above. However, as mentioned above, in the embodiment of FIGS. 10–14 the locking members 50, 52 are positioned within barrel recess 140 such that the flat surfaces of each disc are substantially parallel to the longitudinal axis of the barrel 130. In the embodiment of FIGS. 1–5, the members 50, 52, 54 are positioned such that the flat surfaces of each disc are disposed transversely to the longitudinal axis of the barrel 30. It will be appreciated that these are but two examples of possible orientations of the locking members.

Figure 11:
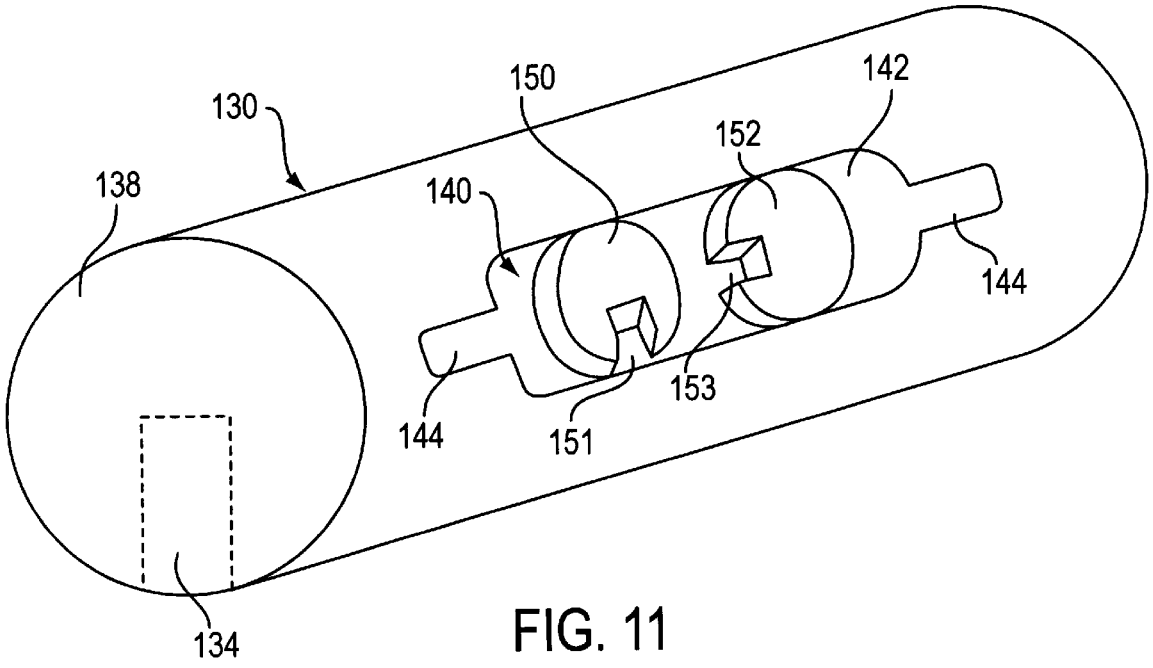
FIG. 11 is a perspective view of the plug and locking members of the lock cylinder of FIG. 10.
Figure 12:
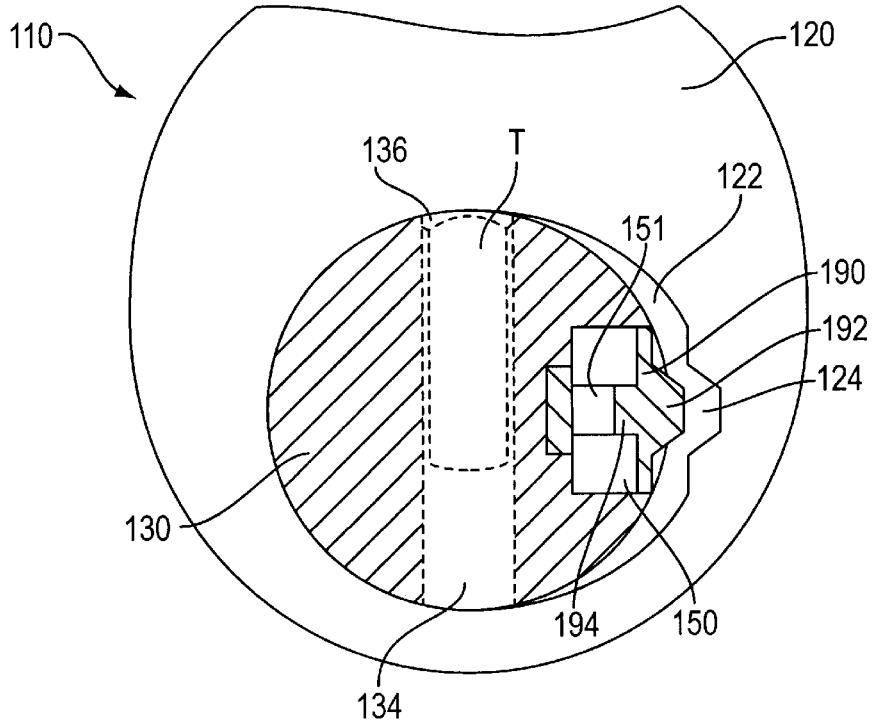
FIG. 12 is a front elevation view in section of a lock cylinder of FIG. 10 with the movable locking members and side bar oriented in a cylinder unlocking position.
Figure 13:
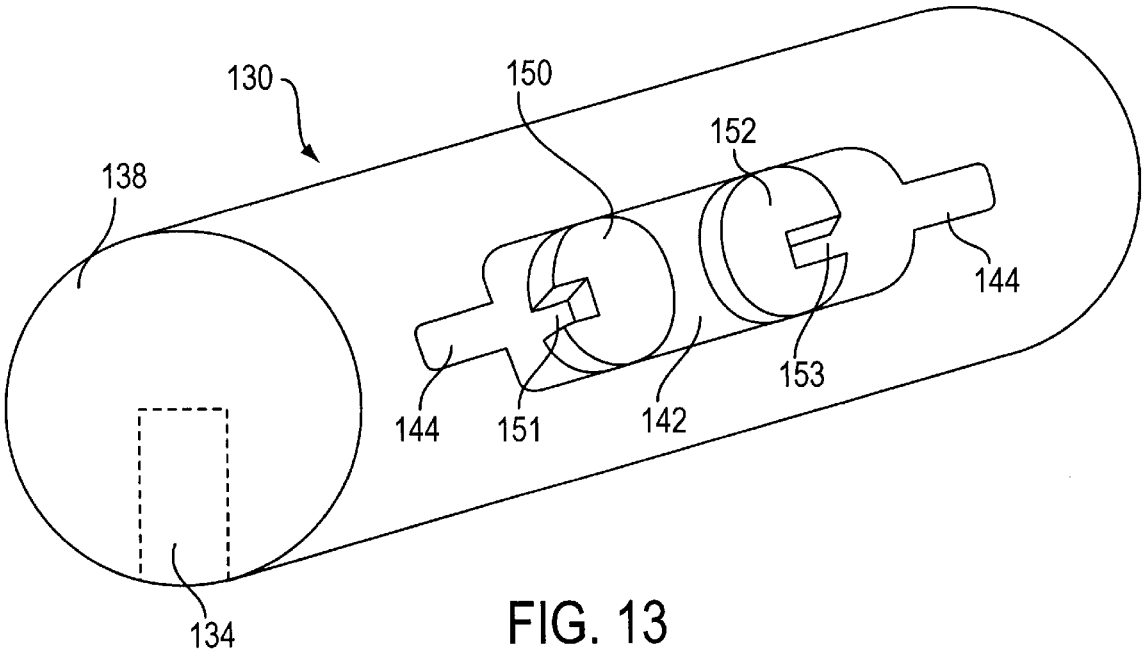
FIG. 13 is a perspective view of the plug and locking members of the lock cylinder of FIG. 12.

The manner in which the members 150, 152 are rotated can be seen by comparing FIG. 11 with FIG. 13. In FIGS. 10 and 11, the members 150, 152 are oriented such that the grooves 151, 153 therein are not aligned and will not accept the inner edge 194 of side bar 190. Thus, the barrel 130 cannot be rotated relative to the shell 120. Upon energizing the electronic drive mechanism (not shown in FIGS. 10–14), the discs 150, 152 are rotated to their unlocking position shown in FIGS. 12 and 13. In this position, the grooves 151, 153 are aligned so as to receive the inner edge 194 of side bar 190, which permits the barrel 130 to be rotated to cam side bar outer edge 192 from the cavity 124 in shell 120 in manner similar to that described above in connection with the previous embodiments. The specific orientation of the locking members of this (and the previous) embodiment in the locking and unlocking positions may be varied without departing from the spirit of the invention. For example, the members 150, 152 may be rotated to move the grooves 151, 153 to any desired unlocking position as long as the side bar 190 engages or is received therein upon rotation of the barrel 130. Further, as in the above embodiment, the locking members preferably are rotated in opposite directions to provide increased security against tampering or unauthorized attempts to open the lock.

Figure 14:
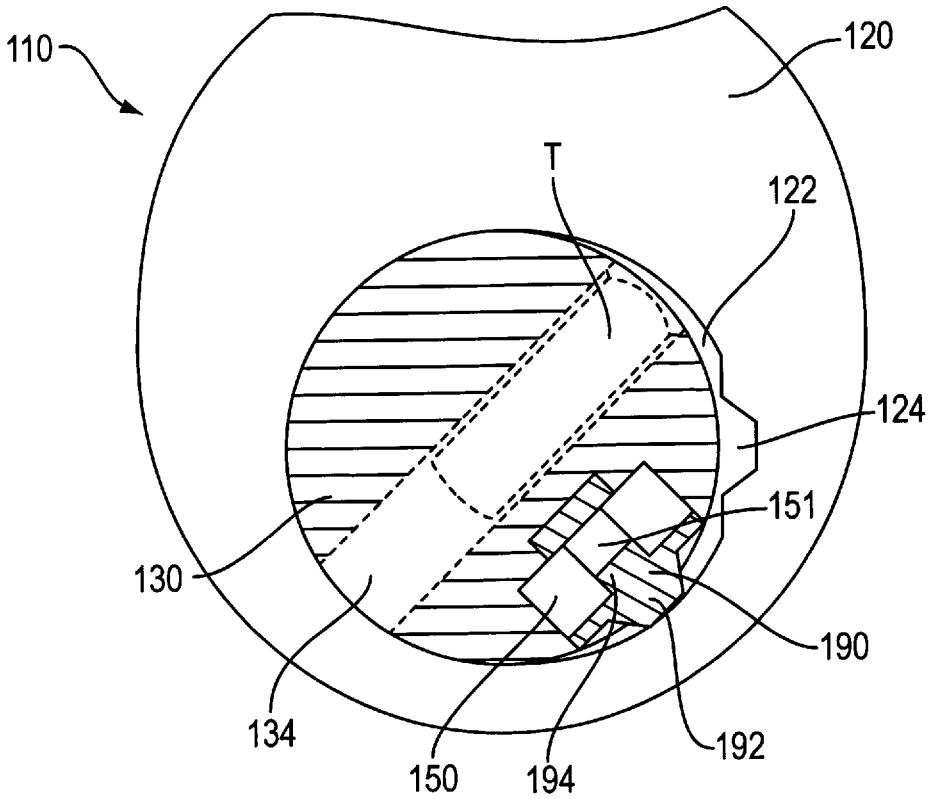
FIG. 14 is a front elevation view in section of a lock cylinder of FIGS. 10–13 with the movable locking members and side bar oriented in the cylinder unlocking position and the plug rotated with respect to the shell.

FIG. 14 shows the lock 110 with the barrel 130 rotated relative to the shell 120 after the side bar 190 has been cammed out of cavity 124. As can be seen, the inner edge 194 of side bar 190 is received in the groove 151 of locking member 150 which permits the outer edge 192 of the side bar to clear the inner surface of the shell bore 122. Insertion of a key into the keyway 134 lifts tumbler pins T to the shear line and, in addition, interfaces with the control device (not shown in FIGS. 10–14) to activate the drive mechanism to rotate the locking members to their unlocking position.

Figure 16:
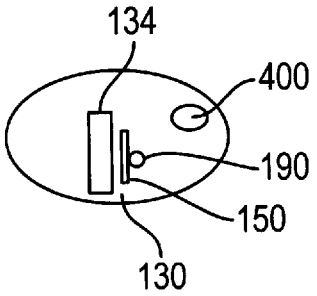
FIG. 16 is a schematic diagram of the rotatable barrel of the embodiment shown in FIGS. 10–14.

FIG. 16 illustrates a preferred arrangement of the drive mechanism and the locking member 150, 152. As in the previous embodiment, the barrel 130 includes a keyway 134 running through the length thereof, and has side bar 190 and locking members 150, 152 (only one of which is depicted) disposed therein. An electromagnetic core 400 is located in the barrel 130 at a location such that upon energizing of the core 400 the locking members are rotated from their locking position (FIG. 11) to their unlocking position (FIG. 13), thereby permitting the side bar 190 to be cammed out of the cavity in the shell and into engagement with the locking members. As in the previous embodiment, alternative electronically powered drive mechanisms may be used in place of the electromagnetic core.

An electromechanical cylinder lock constructed according to the present invention provides a high security lock with dual locking features, namely, a set of conventional tumbler pins which must be lifted (either linearly or rotatively) to the shear line of the barrel, and a set of electromechanical locking members which must be moved, for example rotated, to an unlocking position which permits the side bar to be retracted from the shell. The first locking feature may be controlled mechanically by insertion of a properly bitted key into the keyway, and the second locking feature controlled electromechanically by a microprocessor which activates a drive mechanism to rotate the locking members in response to insertion of the key. Further, the locking members may be configured to rotate in opposite (or different) directions to provide added security against tampering.

In addition, the invention permits conventional mechanical locks to be retrofitted into electromechanical locks. For example, a conventional lock, which includes a plurality of tumbler pins that are both raised to a shear line and rotated to a position to accept the legs of a side bar by inserting a properly bitted key into the keyway, can be retrofitted by replacing the barrel with an electromechanical barrel constructed according to the invention. The electromechanical barrel includes a keyway with a plurality of tumbler pins and a plurality of locking members, the locking members being rotated by an electronic drive mechanism so as to permit the side bar to be retracted and the lock operated. In this manner, a purely mechanical lock, which is subject to the limitations discussed above, may be retrofitted into an electromechanical lock which provides the benefits associated with utilizing an electronically controlled locking feature.

Those skilled in the art will recognize the many advantages and great flexibility provided by the present invention. It should be recognized that the preferred embodiments discussed above have been described in detail so as to provide a full and complete disclosure thereof, and are only exemplary of the many possible variations and applications of the teachings of the present invention.

What is claimed is:

1. An electromechanical lock cylinder comprising:

an outer shell having a bore formed therein and a cavity extending from the bore into the shell;

a barrel disposed within the bore in the shell and being rotatable relative thereto;

a side bar cooperating between the shell and the barrel for selectively permitting and blocking rotation of the barrel with respect to the shell, the side bar having a first portion engaging the barrel and a second portion removably received in the cavity in the shell, the side bar being movable relative to the barrel;

wherein at least one electromechanical locking member is disposed within the barrel and is positionable in a barrel blocking position which blocks rotation of the barrel with respect to the shell, and also is positionable in a non-barrel blocking position which permits the side bar to be moved relative to the cavity in the shell to rotate the barrel with respect to the shell;

an electronically powered drive mechanism located within the barrel and cooperating with the electromechanical locking member to selectively move the locking member from the barrel blocking position to the non-barrel blocking position in which the side bar moves out of the cavity and engages the locking member to rotate the barrel and operate the lock; and control means for activating the electronically powered drive mechanism in response to an authorized attempt to operate the lock cylinder.

2. A lock cylinder according to claim 1, wherein the first portion of the side bar is an outer edge and the second portion is an opposite inner edge, and when the at least one locking member is in said barrel blocking position the outer edge of the side bar is received in the cavity formed in the shell, and wherein the at least one locking member has a groove which receives the inner edge of the side bar when the at least one locking member is in said non-barrel blocking position.

3. A lock cylinder according to claim 2, wherein a plurality of electromechanical locking members are disposed within the barrel, and the side bar includes a plurality of projections respectively received in a groove formed in each locking member.

4. A lock cylinder according to claim 2, wherein the groove in the locking member has first and second groove portions one of which portions extends further into the locking member than the other, and wherein the inner edge of the side bar has first and second portions respectively received in the first and second groove portions of the groove in the locking member.

5. A lock cylinder according to claim 3, wherein the electromechanical locking members are disc-shaped with two opposite substantially flat surfaces joined by a cylindrical portion extending therebetween, and the discs are rotated by the electronically powered drive mechanism.

6. A lock cylinder according to claim 5, wherein the groove cuts through the two flat surfaces and into the cylindrical portion of each disc-shaped locking member.

7. A lock cylinder according to claim 1, wherein the electronically powered drive mechanism is an electromagnetic core and the electromechanical locking member is formed at least in part of a ferromagnetic material, and wherein the electromagnetic core is energized to rotate the locking members.

8. A lock cylinder according to claim 1, wherein a plurality of electromechanical locking members are disposed within the barrel and are driven in opposite directions by the electronically powered drive mechanism.

9. A lock cylinder according to claim 1, wherein the barrel has a keyway formed therein and the control device activates the electronically powered drive mechanism in response to insertion of a key in the keyway.

10. A lock cylinder according to claim 9, further comprising a plurality of tumbler pins disposed adjacent to the keyway and selectively movable to a shear line to permit rotation of the barrel relative to the shell by a properly bitted key inserted into the keyway.

11. A lock cylinder according to claim 1, wherein the electromechanical locking member and the electronically powered drive device are substantially entirely contained within the barrel.

12. A lock cylinder according to claim 1, wherein the barrel has a portion thereof removed to form a recess which extends along at least a portion of the barrel, the recess extending inward from the exterior of the barrel with the at least one electromechanical locking member located therein.

13. A lock cylinder according to claim 5, wherein the locking members are disposed within the recess with the flat surfaces oriented substantially transversely with respect to a longitudinal axis of the barrel.

14. A rotatable lock barrel for insertion into a lock cylinder having a bore formed therein, the barrel comprising:

an elongated, generally cylindrically shaped barrel member having an exterior configured for receipt in a bore of a lock cylinder and an interior containing a plurality of electromechanical locking members, the barrel member having a recess formed therein;

wherein the locking members are disposed in the recess of the barrel member and are substantially entirely contained within the barrel member, each of the locking members including a groove and the locking members being movable to a position in which the grooves of the locking members are aligned;

the recess in said barrel member being configured to receive at least a portion of a movable side bar of a lock cylinder to permit the side bar to move into and out of engagement with the grooves of the locking members for selectively permitting and blocking rotation of the barrel member with respect to a lock cylinder when positioned therein;

an electronically powered drive mechanism located within the barrel member for moving the electromechanical locking members to a position in which the grooves of the locking members are aligned.

15. A rotatable lock barrel according to claim 14, wherein the electronically powered drive mechanism rotates the electromechanical locking members within the barrel member.

16. A rotatable lock barrel according to claim 14, wherein the electromechanical locking members are discs having opposite flat surfaces and the grooves are formed in an edge portion of each discs.

17. A lock cylinder according to claim 16, wherein the locking members are disposed within the recess with the flat surfaces oriented substantially transversely with respect to a longitudinal axis of the barrel member.

18. A rotatable lock barrel according to claim 14, further comprising a keyway formed therein for receiving a key, and a plurality of bores for receiving tumbler pins engaged by the key.

19. A process of retrofitting a mechanical cylinder lock to form an electromechanical cylinder lock, the process comprising steps of:

a) providing a mechanical cylinder lock including an outer shell with a bore, a first rotatable barrel located in the bore, and a side bar for preventing and permitting rotation of the barrel within the bore in the shell;

b) removing the first barrel from the shell;

c) providing an electronically powered rotatable barrel having an exterior adapted to substantially correspond to the bore in the shell, and including:

at least one electromechanical locking member disposed in the barrel, the electromechanical locking member being positionable to permit the side bar to engage the locking member in a non-barrel blocking position which permits the barrel to rotate with respect to the shell, and the electromechanical locking member also being positionable in a barrel blocking position which blocks rotation of the barrel with respect to the shell; and an electronically powered drive mechanism cooperating with the electromechanical locking member to selectively move the locking member from the barrel blocking position to the non-barrel blocking position in which the side bar engages the locking member to rotate the barrel and operate the lock; and d) securing the electronically powered rotatable barrel in the bore in the shell to form an electromechanical cylinder lock, the lock including control means carried by at least one of the barrel and bore for energizing the electronically powered drive mechanism in response to an authorized attempt to open the lock.

* * * * *